US007452039B1

(12) United States Patent
Golias, Jr. et al.

(10) Patent No.: US 7,452,039 B1
(45) Date of Patent: Nov. 18, 2008

(54) CABINET SHELF WITH KEYED SLOT

(75) Inventors: Bernard J. Golias, Jr., Twinsburg, OH (US); Robert J. Golias, Solon, OH (US); Gary W. James, Parma Heights, OH (US); Gary R. Kish, Parma, OH (US); Bernard J. Golias, Sr., Parma, OH (US)

(73) Assignee: Metal Fabricating Corporation, Cleveland, OH (US)

( * ) Notice: Subject to any disclaimer, the term of this patent is extended or adjusted under 35 U.S.C. 154(b) by 165 days.

(21) Appl. No.: 10/915,450

(22) Filed: Aug. 10, 2004

(51) Int. Cl.
*A47F 5/00* (2006.01)

(52) U.S. Cl. ..... 312/257.1; 108/60; 211/184

(58) Field of Classification Search ..... 312/233, 312/257.1, 348.3, 263, 265.5, 351; 211/135, 211/184, 186; 108/60, 61, 106–110, 180, 108/193; 220/529, 532, 533
See application file for complete search history.

(56) References Cited

U.S. PATENT DOCUMENTS 809,497 A * 1/1906 Dick ..... 109/53
1,523,653 A 1/1925 Larson et al.
1,840,485 A * 1/1932 Butler ..... 206/0.81
2,164,394 A * 7/1939 Faber ..... 454/232
D116,600 S 9/1939 Thorn et al.
2,761,640 A 9/1956 Frater
2,889,055 A * 6/1959 Walter et al. ..... 211/184
3,097,746 A * 7/1963 Handler et al. ..... 211/133.3
D211,139 S 5/1968 Nowak
3,389,949 A 6/1968 Studinski et al.
3,548,505 A 12/1970 Candilo
3,572,874 A 3/1971 Hassel
3,581,906 A * 6/1971 Joyce ..... 211/126.5
3,687,091 A * 8/1972 Boylan ..... 108/60
3,809,352 A 5/1974 Mathias
3,905,484 A * 9/1975 Dean et al. ..... 211/184
4,029,282 A 6/1977 Dauth
4,064,813 A * 12/1977 Hewett et al. ..... 108/60
4,067,632 A 1/1978 Sekerich
4,070,076 A 1/1978 Zwillinger
4,155,312 A 5/1979 Thorkildson
4,193,650 A * 3/1980 Gray et al. ..... 312/205
4,258,892 A 3/1981 Craine
4,295,693 A 10/1981 Viklund
4,681,381 A 7/1987 Sevey
4,759,449 A * 7/1988 Gold ..... 211/43
4,795,042 A * 1/1989 Klein et al. ..... 211/186
D300,147 S 3/1989 Meyer et al.
4,828,133 A * 5/1989 Hougendobler ..... 220/533
D309,540 S 7/1990 Suttles et al.
4,949,853 A * 8/1990 Klein et al. ..... 211/186
D311,285 S 10/1990 Mastrodicasa
D314,114 S 1/1991 Steinman
5,058,765 A * 10/1991 Gomi et al. ..... 220/528
D323,091 S 1/1992 Boschetto
D333,394 S 2/1993 Warrington
D334,494 S 4/1993 Stein
5,209,452 A 5/1993 Goldberg
5,267,383 A 12/1993 Sawdon (Continued)

*Primary Examiner*—Janet M Wilkens
(74) *Attorney, Agent, or Firm*—Fay Sharpe LLP

(57) ABSTRACT

A shelf for a cabinet includes a planar member and a ramp extending at an obtuse angle from the planar member. The ramp includes a key-shaped opening formed in the ramp for receiving a divider wall.

14 Claims, 3 Drawing Sheets

U.S. PATENT DOCUMENTS 5,329,835 A 7/1994 Timp et al.
5,470,143 A 11/1995 Gill
5,595,127 A * 1/1997 Eustace et al. ..... 108/109
5,613,449 A 3/1997 Pullman
5,695,261 A 12/1997 Slesinger et al.
5,702,011 A 12/1997 Carroll
D392,131 S 3/1998 Flagg
5,737,819 A 4/1998 Sawdon et al.
D395,369 S 6/1998 Whittington
5,785,401 A 7/1998 Bowyer et al.
D402,143 S 12/1998 Zapf
D407,011 S 3/1999 Boije
D424,330 S 5/2000 DeWitt
6,076,908 A 6/2000 Maffeo
D429,417 S 8/2000 Liebers et al.
D431,403 S 10/2000 Ford
6,170,674 B1 1/2001 Caterinacci
6,279,445 B1 8/2001 Rosene et al.
6,302,369 B1 10/2001 Liebers et al.
D455,755 S 4/2002 Levine et al.
D457,364 S 5/2002 Shea
D458,484 S 6/2002 Wood
D461,977 S 8/2002 Mitchell
6,490,820 B1 12/2002 Weakley
6,561,601 B1 5/2003 Maffeo
D507,131 S 7/2005 Pingel
6,935,514 B2 * 8/2005 Lackey et al. ..... 211/60.1
D510,220 S 10/2005 Sandy
7,128,379 B1 10/2006 LaBonia, Jr. et al.
7,216,773 B2 * 5/2007 Golias et al. ..... 211/184

* cited by examiner

CABINET SHELF WITH KEYED SLOT

BACKGROUND

The present invention relates generally to units for storage. More particularly, the invention relates to an improved shelf member for a cabinet, such as a metal cabinet.

Metal cabinets and compartment bins are very versatile in that the cabinets can be placed in many areas, such as metal or woodworking shops, garages, as well as many other places. The cabinets and compartment bins can also provide storage in vehicles, such as trucks and vans. Metal cabinets have been used to store a variety of items such as threaded rod, wire, brake line, welding rods, as well as more common items, such as tools and fasteners.

When storing an item on a cabinet shelf, it can be difficult to retrieve the item if the shelf is substantially horizontal. For example, if one is trying to scoop a handful of bolts from a shelf, the vertical and straight front wall of the shelf tends to make it difficult to pull the bolts off the shelf.

Accordingly, it is desired to provide a cabinet with a shelf which aids in manually removing loose items from the cabinet.

SUMMARY OF THE INVENTION

In accordance with one aspect of the invention, a shelf for a cabinet includes a planar member and a ramp extending at an obtuse angle from the planar member. The ramp includes a substantially key-shaped opening formed in the ramp.

A cabinet includes first and second opposing side walls and a shelf mounted to at least one of the side walls. The shelf includes a ramped front portion. The ramped front portion includes a substantially key-shaped opening.

In accordance with another aspect of the invention, a method for assembling a cabinet having two opposing side walls, a shelf having a ramped front portion and a substantially key-shaped opening formed in the front portion, and a divider includes the following steps: mounting the shelf to one of the side walls of the cabinet, and inserting the divider into the key-shaped opening.

Still other aspects of the invention will become apparent to those skilled in the art upon reading and understanding the following detailed description.

BRIEF DESCRIPTION OF THE DRAWINGS

The foregoing and other objects and advantages will in part be obvious and in part pointed out in the following description taken together with the accompanying drawings in which.

DETAILED DESCRIPTION OF THE PREFERRED EMBODIMENT

Referring now in greater detail to the drawings, wherein the showings are for the purpose of illustrating preferred embodiments of the invention only, and not for the purpose of limiting the invention, FIGS. 1-4 illustrate a preferred embodiment of the present invention.

Figure 1:
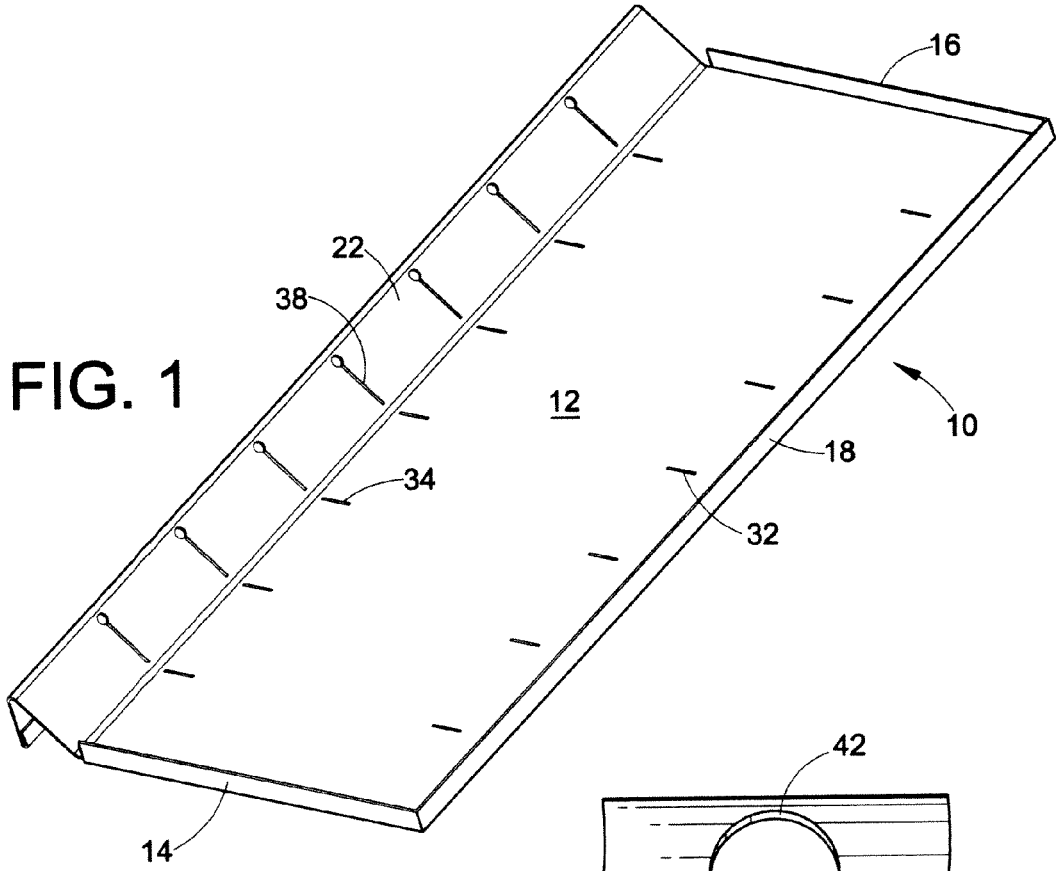
FIG. 1 is a rear perspective view of a cabinet shelf having a keyed slot.
Figure 4:
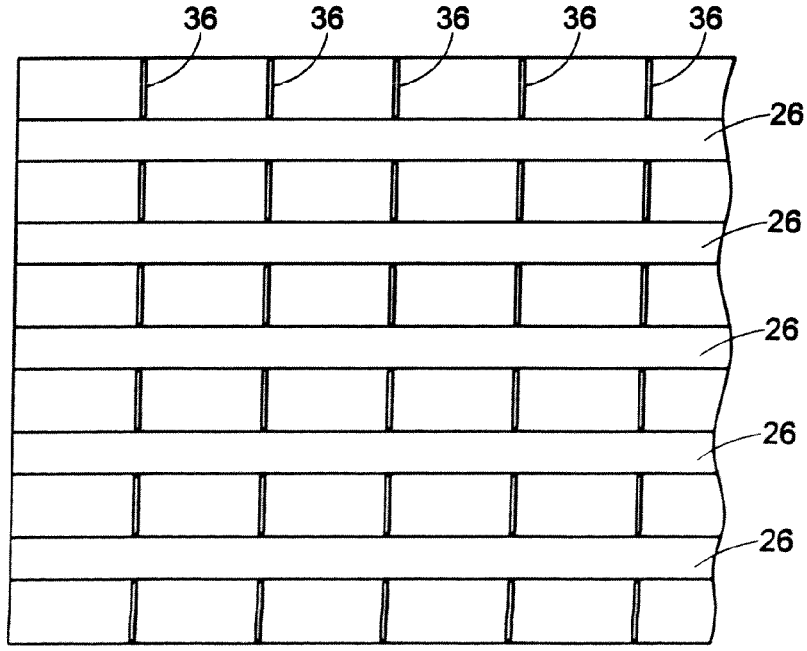
FIG. 4 is a front view of a cabinet including the cabinet shelf of FIG. 1.
Figure 5:
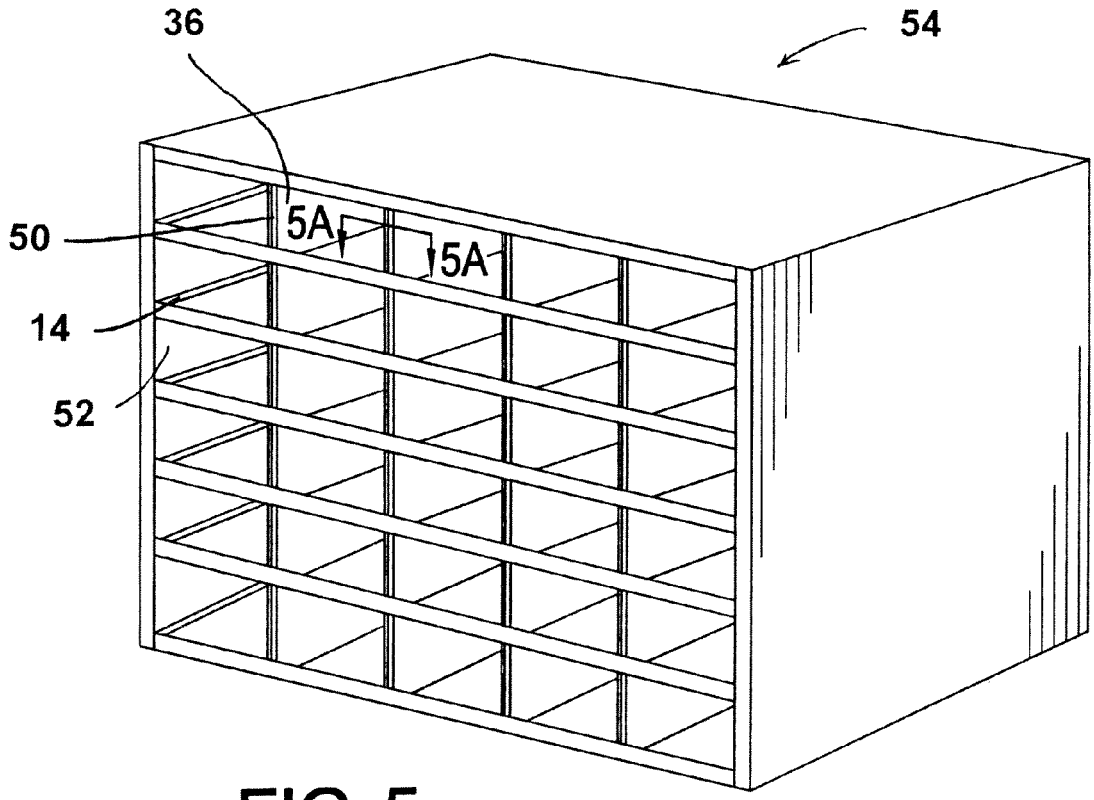
FIG. 5 is a perspective view of the cabinet depicted in FIG. 4.

With reference now to FIG. 1, a shelf 10 includes a sheet or planar surface 12, side walls 14 and 16, rear wall 18, and a ramped front portion 22. Shelf 10 is formed from a rigid metal or other suitable material. Sheet 12 is shown to be substantially rectangular; however, the sheet could take other suitable configurations for various shaped or sized cabinets. Side walls 14 and 16 each extend substantially orthogonally from sheet 12. The side wall 16 is positioned at an opposite longitudinal end of sheet 12 as the side wall 14. Rear wall 18 extends from an edge of the sheet between side walls 14 and 16 and also extends substantially orthogonally from sheet 12. Referring to FIG. 4, side walls 14 and 16 provide a surface of attachment for the shelf 10 to a side wall 52 corresponding cabinet 54 (see FIG. 5). Likewise, the rear wall 18 also provides a surface to attach the shelf 10 to a rear wall of a cabinet.

Figure 2:
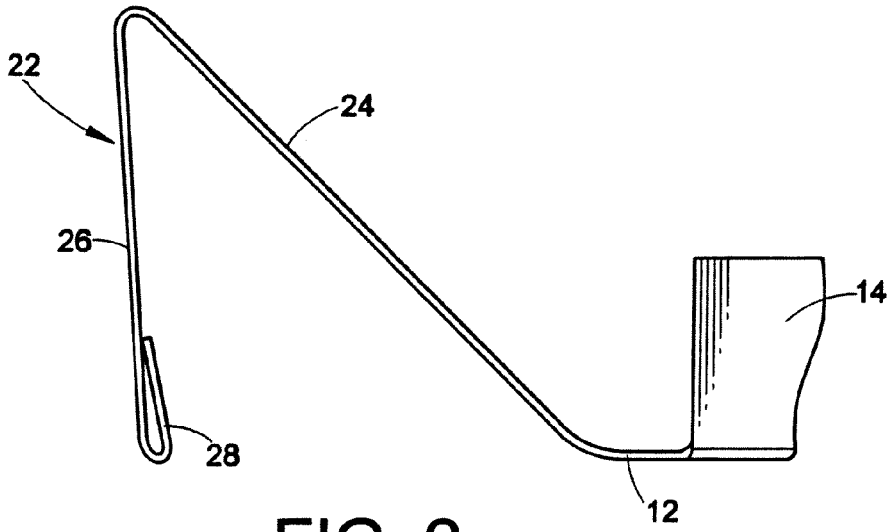
FIG. 2 is a side elevation view of a front portion of the shelf of FIG. 1.

Ramped front portion 22 is positioned opposite the rear wall 18. Referring now to FIG. 2, the ramped front wall portion includes an inclined wall 24 and a straight or substantially vertical wall 26. Inclined wall 24 extends upwardly from sheet 12 forming an obtuse angle between the inclined wall and the sheet. Vertical wall 26 extends in a downwardly direction from the inclined wall 24. A rounded bend or corner is formed between walls 24 and 26. Wall 26 forms the front wall when viewing the shelf 10 from the front of the cabinet (FIG. 4). Wall 26 can also include a crimped portion 28 at a lower most edge which provides a rounded edge for the front portion of the shelf 10.

With reference back to FIG. 1, the shelf further includes a plurality of rear slots 32 disposed adjacent the rear wall and a plurality of front slots 34 disposed adjacent the ramped front portion 22. Slots 32 can be equally spaced apart and parallel to each other. Likewise, slots 34 can be equally spaced apart and parallel to each other. The slots can be unevenly spaced as well without departing from the scope of the present invention. Referring to FIG. 4, slots 32 and 34 are aligned with one another and receive a portion of dividers 36 that divide the shelf 10 into a plurality of compartments defined by adjacent parallel slots.

Figure 3:
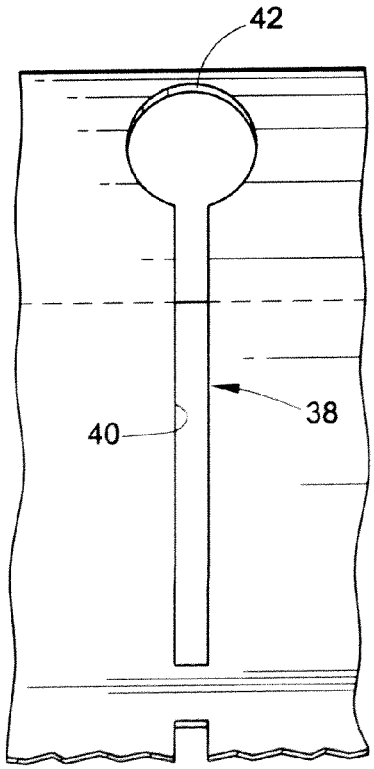
FIG. 3 is a close-up view of a keyed slot in a front wall portion of the shelf of FIG. 1.
Figure 5A:
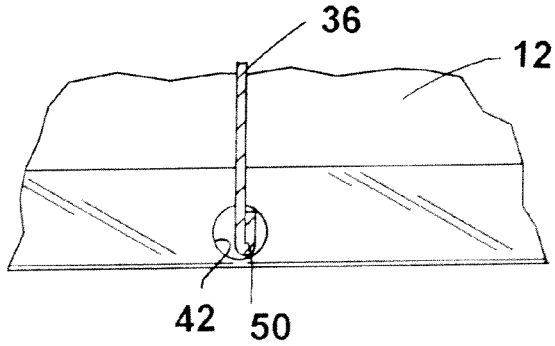
FIG. 5A is a cross-sectional view taken at line 5A-5A in FIG. 5.

The ramped front portion 22 also includes a plurality of openings or slots 38 aligned with rear slots 32 and front slots 34. Slots 38 in the ramped front portion also receive the same dividers 36 that slots 32 and 34 receive. Referring now to FIG. 3, each slot in the ramped portion can have a key-shaped conformation, including a narrow portion 40 terminating in a relatively wider circular or round aperture 42 adjacent the intersection of the inclined wall 24 and the vertical wall 26 of the ramped front wall. Aperture 42 provides a larger opening allowing for an easier insertion of the divider 36 into the slot 38, thus reducing assembly time. The narrow portion 40 extends from the wider portion 42 and terminates at or adjacent the planar surface 12. A reinforced rolled end 50 (FIG. 5A) of the divider can be received within the slot. The keyed slot 38 also adds strength and rigidity to a divider since the divider wall has support from the ramped wall on both sides of the divider. The slot further aids the divider wall in maintaining a vertical position in the cabinet.

The ramped front portion 22 provides an abutment so that when the user attempts to retrieve a handful of items from a compartment that is defined by two adjacent dividers 36 and the shelf 10, the ramped front portion serves as a scoop to aid the user in retrieving items from the shelf. Furthermore, items that are not retrieved will roll back into the shelf and not fall from the shelf.

The shelf member has been described with reference to a preferred embodiment. Obviously, modifications and alterations will occur to others upon the reading and understanding of this specification. The specification is intended to include all such modifications and alterations insofar as they come within the scope of the appended claims or the equivalents thereof.

The invention claimed is:

1. A metal cabinet assembly comprising:

first and second opposed side walls;

at least one shelf interposed between said first and second side walls, said shelf comprising a first planar member including at least one elongated slot formed through the first planar member;

said shelf further comprises a second member including a first substantially flat planar wall which extends at an obtuse angle from the first planar member, wherein the first planar wall has at least one key-shaped opening formed through the first planar wall and substantially aligned with the at least one elongated slot, said key-shaped opening having a circular portion at an end of said key-shaped opening;

said second member includes a second planar wall extending at an acute angle from said first planar wall of said second member, wherein said second planar wall terminates in a rolled edge;

wherein said shelf further comprises a third wall extending from the first planar member for fixedly securing the shelf to one of said first and second opposed side walls of said cabinet assembly, wherein the third wall terminates at an end spaced from the second member; and, a divider wall having a rolled edge, wherein said divider wall is selectively received in said elongated slot, and said rolled edge of said divider wall is selectively received in said key-shaped opening.

2. The cabinet assembly of claim 1, wherein said third wall of said shelf extends substantially orthogonally from the first planar member.

3. The cabinet assembly of claim 1, wherein said key-shaped opening has a first portion and a second portion, wherein said second portion is formed adjacent an intersection of the first planar wall and the second planar wall of said second member.

4. The cabinet assembly of claim 3, wherein said key-shaped opening second portion is wider than said key-shaped opening first portion.

5. The cabinet assembly of claim 1, wherein the second planar wall of said second member is situated substantially perpendicular to the first planar member.

6. A cabinet comprising:

first and second opposing side walls;

a plurality of shelves, wherein each shelf is mounted to at least one of the side walls, each shelf including a ramped front portion and a planar portion, wherein the ramped front portion includes a first substantially flat planar portion that extends at an obtuse angle from the planar portion and a second planar portion that depends at an acute angle downwardly from the first portion, wherein the ramped front portion also includes a substantially key-shaped opening having an elongated narrow slot terminating in a circular portion adjacent an intersection of the first portion and the second portion of the ramped front portion; and a divider having a rolled edge wherein the rolled edge of the divider is received in the circular portion of the opening.

7. The cabinet of claim 6, wherein the ramped front portion includes a lower rolled edge.

8. The cabinet of claim 6, wherein the shelf includes a first slot formed in the planar portion and aligned with the opening, wherein at least a portion of the divider is received in the first slot.

9. The cabinet of claim 8, wherein the first slot is at least substantially perpendicular to the second portion of the ramp.

10. The cabinet of claim 8, wherein the shelf includes a second slot formed in the planar portion and aligned with the first slot, wherein at least a portion of the divider is received in the second slot.

11. The cabinet of claim 6, further comprising a rear wall connected to the first wall and the second wall, and the shelf includes a rear wall portion extending from the planar portion, the rear wall portion of the shelf attaches to the rear wall of the cabinet.

12. A cabinet assembly comprising:

a shelf having a planar portion and an integral ramped portion extending at an obtuse angle from the planar portion, the ramped portion including a first flat planar wall having an opening formed therethrough having a narrow elongated slot and a circular wider portion extending from the narrow elongated slot adjacent an apex of the ramped portion, a second flat planar wall extending from said first flat planar wall at an acute angle at said apex of the ramped portion; and a divider wall having a reinforced rolled edge received in said circular portion of said opening.

13. The shelf of claim 12, further comprising at least two aligned slots formed in the planar member for receiving the divider that is received in the opening.

14. The shelf of claim 12, further comprising an integral side wall extending substantially orthogonally from the shelf, an end of the side wall being spaced from the integral ramped portion.

* * * * *